US005151037A

United States Patent [19]

Range et al.

[11] Patent Number: 5,151,037

[45] Date of Patent: Sep. 29, 1992

[54] TRANSPARENT CONTACT RAIL

[75] Inventors: Helmut Range, Lemgo; Gerhard Beigel, Detmold, both of Fed. Rep. of Germany

[73] Assignee: Staff GmbH & Co. KG, Lemgo, Fed. Rep. of Germany

[21] Appl. No.: 691,847

[22] Filed: Apr. 26, 1991

[30] Foreign Application Priority Data

Apr. 27, 1990 [DE] Fed. Rep. of Germany ..... 4013529

[51] Int. Cl.[5] ..... H01R 25/14

[52] U.S. Cl. ..... 439/110; 174/70 C

[58] Field of Search ..... 439/110, 112; 362/801; 174/70 C; 191/23 A

[56] References Cited

U.S. PATENT DOCUMENTS

| | | | |
|---|---|---|---|
| 4,861,273 | 8/1989 | Wenman et al. | 439/111 |
| 4,941,207 | 7/1990 | Maeda et al. | 455/617 |
| 5,019,944 | 5/1991 | Ishii et al. | 361/400 |

FOREIGN PATENT DOCUMENTS

| | | | |
|---|---|---|---|
| 764151 | 12/1956 | United Kingdom | 191/23 A |
| 2185863 | 7/1987 | United Kingdom | 439/119 |

*Primary Examiner*—Gary F. Paumen

*Attorney, Agent, or Firm*—Pollock, Vande Sande & Priddy

[57] ABSTRACT

A contact rail with two conductors that are arranged on opposite sides of a transparent isolated support member and can be tapped from the outside. The support member is preferably made of glass material.

10 Claims, 2 Drawing Sheets

TRANSPARENT CONTACT RAIL

FIELD OF THE INVENTION

The present invention refers to a contact rail with conductors arranged on opposite sides of a transparent support.

BACKGROUND OF THE INVENTION

In one prior art contact rail of this type, disclosed in DE-GM8715494, the contact rail is round in shape and consists of transparent plastic material.

Contact rails made of transparent plastic material have not been frequently used, in practice, since their stiffness and stability is insufficient. Furthermore, the optical characteristics of such transparent plastic rails are also insufficient. When glass fibers or other inlays are employed to increase the stability, the optical characteristics of such a contact rail are no longer satisfactory.

SUMMARY OF THE INVENTION

The present invention contact rail is designed in such a way that on the one hand, it is substantially solid and, on the other hand, it also has excellent optical characteristics.

These advantageous characteristics of the present contact rail have been achieved by providing the support body made of glass material.

The use of glass as a support body for contact rails is a new idea. It turns out that the glass is well adapted in many cases as a construction material for a support body in a contact rail. Use of glass, for example, provides an optically satisfactory solution. Such a glass contact rail can be integrated into the surroundings in an optically very favorable way.

BRIEF DESCRIPTION OF THE DRAWINGS

Some preferred embodiments of the present invention are described below with reference being made to the accompanying drawings, wherein.

DETAILED DESCRIPTION OF THE PREFERRED EMBODIMENT(S)

Figure 1:
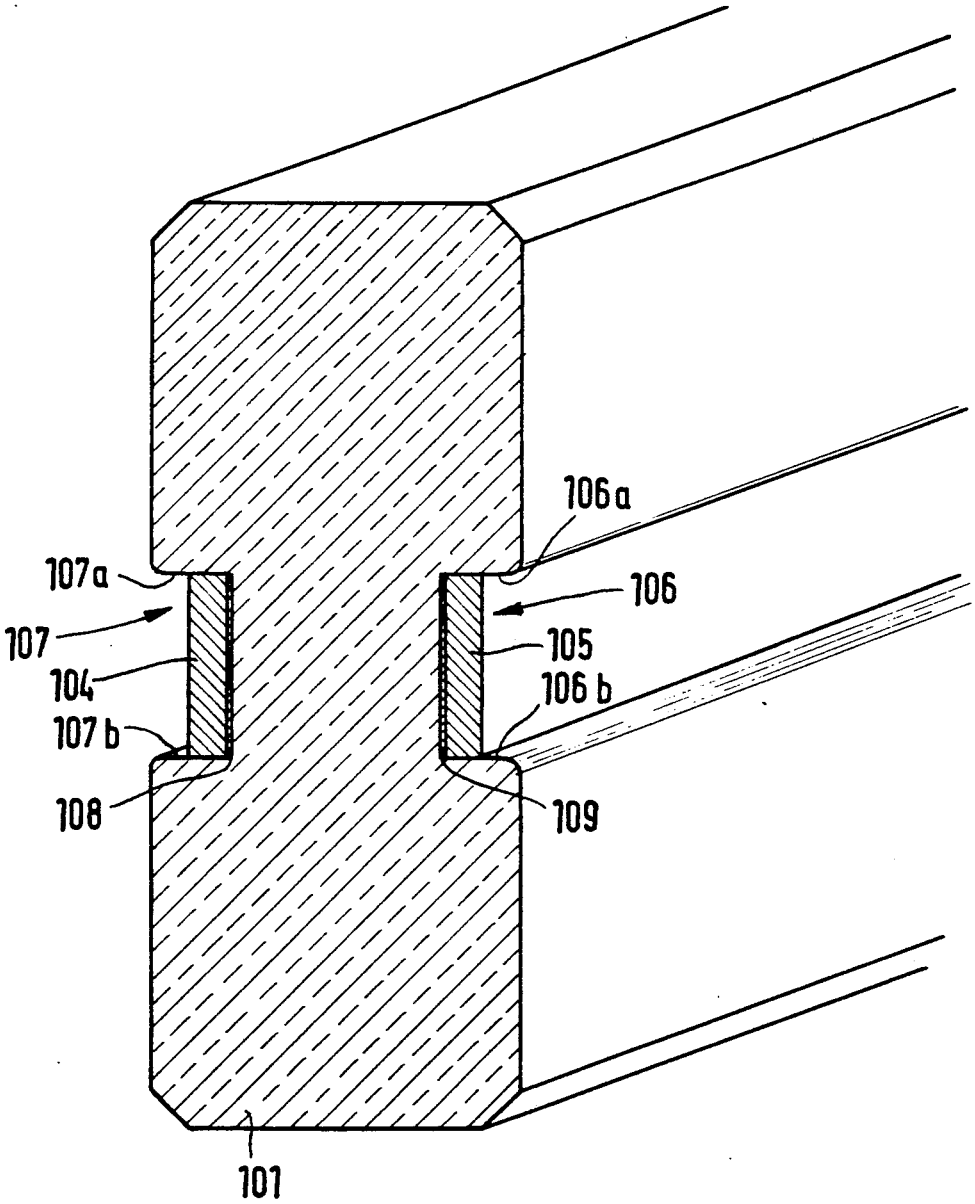
FIG. 1 shows a cross-sectional view of a first embodiment of the contact rail according to the present invention.

In the embodiment according to FIG. 1 a support member 101 is made of a solid glass. The support member 101 has a rectangular cross-section with bevelled corners. Substantially in the middle of the two broadsides of the support member there are provided longitudinal grooves 106 and 107. Conductors 104 and 105 are inserted into the longitudinal grooves and are adapted to fit into their width. The conductors 104 and 105 are fixed to the glass support member 101 at the bottom of the longitudinal grooves 106 and 107 through transparent adhesive layers 108 and 109, which can be formed by double-coated transparent tape.

The reference numerals in the second embodiment are chosen such that they substantially correspond to those of the first embodiment, but are reduced by an amount of 100.

Figure 2:
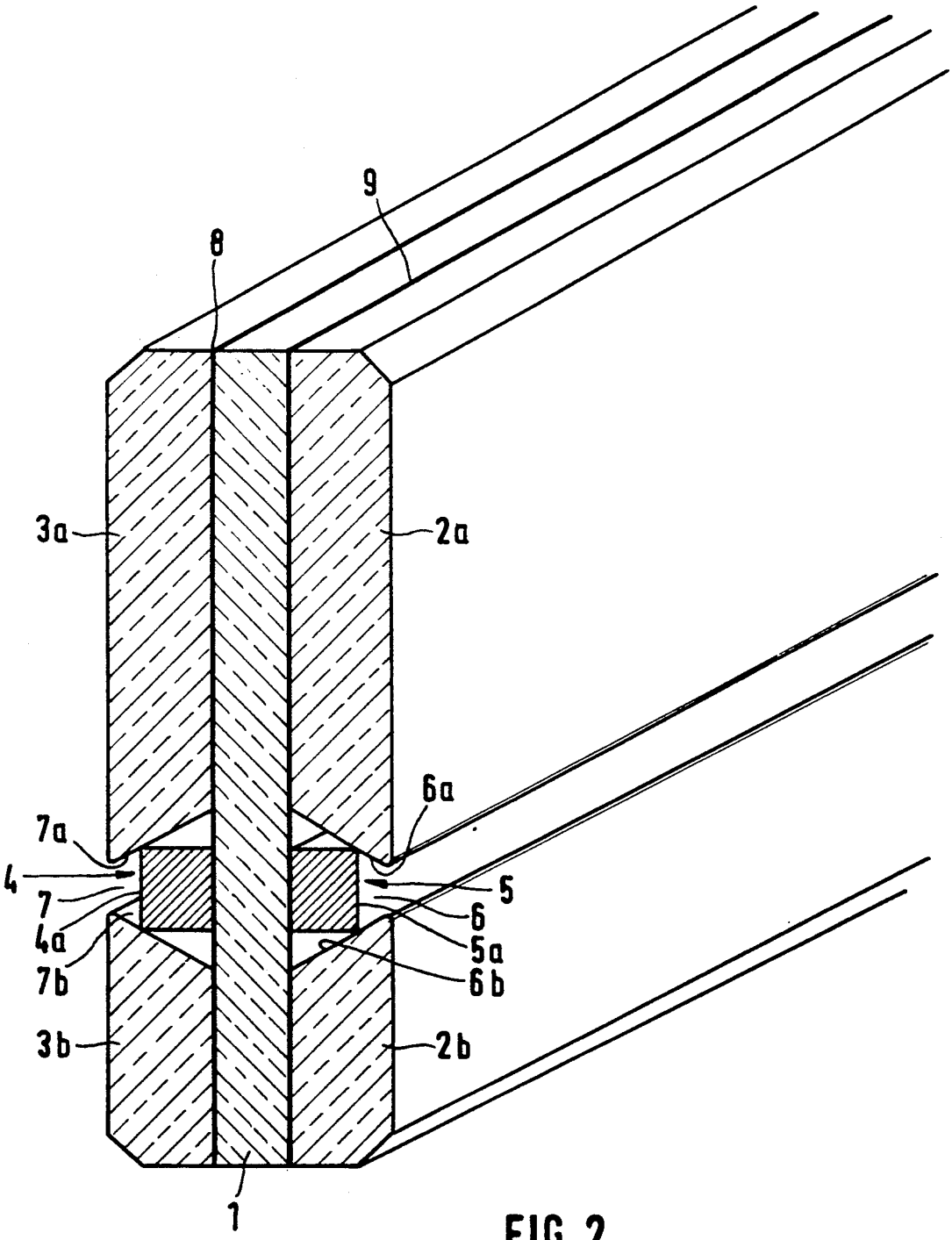
FIG. 2 shows a cross-sectional view of a second embodiment of the contact rail.

In the embodiment according to FIG. 2, the support member is made of several layers. It includes a middle layer 1 consisting of glass and two double-coated transparent adhesive layers 8 and 9 which are applied onto this middle layer 1. The adhesive layers 8 and 9 fix the outer divided (split) layers 2*a* and 2*b*, onto one side of the middle layer 1 and outer layers 3*a* and 3*b* on the other side of the middle layer 1.

Each divided (split) layer consists of an upper part 2*a*, 3*a* and a lower part 2*b*, 3*b*. The lower and upper parts of each outer layer are spaced apart such that longitudinal grooves 6 and 7 are formed therebetween. As shown in FIG. 2, the surfaces of the corresponding lower and upper parts which define each groove therebetween are inclined in such a way that the grooves converge in shape in the direction from the middle layer towards the outer surfaces of the outer layers. The upper outer corner of each upper part of the divided outer layers is bevelled, as is the lower outer corner of each lower part.

The conductors 4 and 5 are fixed onto the double-coated adhesive layers 8 and 9 and are positioned in the longitudinal grooves 6 and 7, respectively, between inclined surfaces 6*a*, 6*b*, 7*a* and 7*b* which promotes a stable position of the adhered conductors in the longitudinal grooves.

While a preferred embodiment of the present invention has been illustrated and described, it will be appreciated that various changes can be made therein without departing from the spirit and scope of the present invention.

We claim:

1. A contact rail for supporting at least one device insertable thereon to be in electrical contact with the contact rail, said contact rail comprising:

a transparent insulating support member having a rectangular cross section and two electrical conductors extending substantially along the length of said contact rail and arranged in longitudinal grooves at opposite broadsides of the support member, such that the conductors can be tapped from the outside at said two opposite sides, wherein said support member is made of glass.

2. A contact rail according to claim 1, wherein said glass is a silicate glass.

3. A contact rail according to claim 1, wherein the conductors are fixed to said support member through a double coated adhesive, transparent layer provided in said grooves.

4. A contact rail for supporting at least one device insertable thereon to be in electrical contact with the contact rail, said contact rail comprising:

a transparent insulating support member and two electrical conductors extending substantially along the length of said contact rail positioned on opposite sides of the support member, such that the contact surfaces of the conductors are recessed with respect to the adjacent outer contour of the supporting member and can be tapped from the outside at said two opposite sides, wherein said support member is made of glass.

5. A contact rail according to claim 4, wherein said glass is a silicate glass.

6. A contact rail according to claim 4, wherein the conductors are fixed to said support member through a double coated adhesive, transparent layer provided in said grooves.

7. A contact rail comprising:

a transparent insulating support member with a rectangular cross section and two electrical conductors arranged in longitudinal grooves formed on opposite sides of the support member such that the conductors can be tapped from the outside, and wherein said support member is made of glass.

8. A contact rail according to claim 7, wherein said glass is a silicate glass.

9. A contact rail according to claim 7, wherein the conductors are fixed to said support member through a double coated adhesive, transparent layer provided in said grooves.

10. A contact rail according to claim 7, wherein the contact surfaces of the conductors are recessed with respect to the adjacent outer contour of the support member.

* * * * *